United States Patent [19]

Blatt

[11] 4,245,548

[45] Jan. 20, 1981

[54] AUTOMATION VERTICAL LIFT UNIT

[76] Inventor: L. Douglas Blatt, 31915 Groesbeck Hwy., Fraser, Mich. 48026

[21] Appl. No.: 11,800

[22] Filed: Feb. 14, 1979

[51] Int. Cl.[3] ..... F01B 31/12; B66F 3/24

[52] U.S. Cl. ..... 92/5 R; 414/626; 254/93 R

[58] Field of Search ..... 92/5 R, 5 L, 165 R, 92/165 PR; 414/626, 627, 589; 212/128, 129; 254/9 C, 9 R, 9 B, 93 R; 187/8.71, 8.72, 17

[56] References Cited

U.S. PATENT DOCUMENTS

| | | | |
|---|---|---|---|
| 2,411,348 | 11/1946 | Turner | 414/626 X |
| 2,933,198 | 4/1960 | Firestone et al. | 212/128 |
| 3,076,674 | 2/1963 | Anderson | 414/626 X |
| 3,112,676 | 12/1963 | Boulsover | 254/93 R |
| 3,168,011 | 2/1965 | Baumann | 92/5 R X |
| 3,461,805 | 8/1969 | Karkow | 92/5 R X |
| 3,722,709 | 3/1973 | Buschmann | 414/626 X |

*Primary Examiner*—John M. Jillions

*Attorney, Agent, or Firm*—Cullen, Sloman, Cantor, Grauer, Scott & Rutherford

[57] ABSTRACT

A vertical lift unit comprises a horizontally disposed upper plate adapted for suspension from a reciprocal shuttle feed unit, and a horizontally disposed lower plate adapted for supporting a reciprocal work piece gripping, lifting and transport assembly. A cylinder assembly is interposed between and interconnects the plates for effecting relative vertical movement therebetween. A series of bi-fold linkages are mounted quarter laterally in a rectangular pattern around the cylinder assembly and interposed between the plates and at their respective free ends pivotally connected to the plates for providing straight vertical lift motions to the work piece transport assembly. The bi-fold linkages are arranged in opposed spaced pairs, and a combination adjustable lock screw assembly and interconnected shock absorber assembly is interposed between one of said pairs of bi-fold linkages for selectively preadjusting the vertical work stroke of the lower plate and cushioning its downward movement.

7 Claims, 4 Drawing Figures

AUTOMATION VERTICAL LIFT UNIT

BACKGROUND OF THE INVENTION

When loading and unloading formed or flat parts into and out of dies, or other tooling, a straight vertical lift motion is often required. Heretofore in the use of reciprocal work piece gripping, lifting and transport assemblies various efforts have been made to provide for a substantially vertical lifting movement of the gripping mechanism with respect to work piece for lifting the formed work piece with respect to the dies and sequentially retracting the formed work piece. Devices of this type heretofore have been relatively heavy and complicated structure wise for achieving some form of work piece lifting having a vertical component which is usually not directly vertical for raising the formed work piece and removing it from the work area.

SUMMARY OF THE INVENTION

It is the object of the present invention to provide an improved cylinder actuated adjustable mechanical linkage straight lift unit from which is supported a work piece gripping, lifting and transport assembly by which there will be transmitted to the part gripping apparatus a straight vertical lift disengaging the formed work piece from the dies or tool and for retracting the same from the work area.

It is another object to provide a vertical lift unit which includes a horizontally disposed upper plate adapted for suspension from a conventional recriprocal shuttle feed unit and in conjunction with a horizontally disposed lower plate adapted for supporting a reciprocal work piece gripping, lifting and transport assembly, together with a cylinder assembly interposed between the plates and a plurality of bi-fold linkages quarter laterally arranged around the cylinder assembly and interposed between the plates and pivotally connected thereto for providing straight vertical lift motions to the work piece transport assembly.

It is a further object to provide an improved vertical lift unit for use in this environment together with adjustable lockable rod screw assemblies and interconnected shock absorber assemblies interposed between one of the pairs of bi-fold linkages for selectively preadjusting the vertical work lift stroke of the lower plate and cushioning its downward movements.

It is a further object to incorporate within a vertical lift unit having top and bottom plates a series of eight slotted interlocking guide links referred to as opposed pairs of pivotally interconnected bi-fold linkages quarter laterally mounted in a rectangular pattern about a central cylinder assembly between the plates and pivotally connected at their respective ends to the respective plates and wherein the individual guide links of the bi-fold linkages are symmetrical and of H-shape and including spaced apart guide links thereby spreading apart the bearing points providing increased stability when positioned in opposing pairs.

It is a further object to provide between at least one of the opposing pairs of bi-fold linkages of a pair of adjustable lock screw assemblies and interconnected shock absorber assemblies for selectively preadjusting the vertical work stroke of the lower plate and cushioning its downward movements. The adjustable lock screw assemblies and associated shock absorber assemblies provide a means for accurately presetting inward pivotal movements of one of the pairs of bi-fold linkages and thereby accurately presetting the amount of vertical adjustment of the lower plate.

These and other objects will be seen from the following Specification and Claims in conjunction with the appended drawings:

THE DRAWINGS

It will be understood that the above drawings illustrate merely a preferred embodiment of the invention, and that other embodiements are contemplated within the scope of the Claims hereafter set forth.

DETAILED DESCRIPTION OF THE INVENTION

Figure 1:
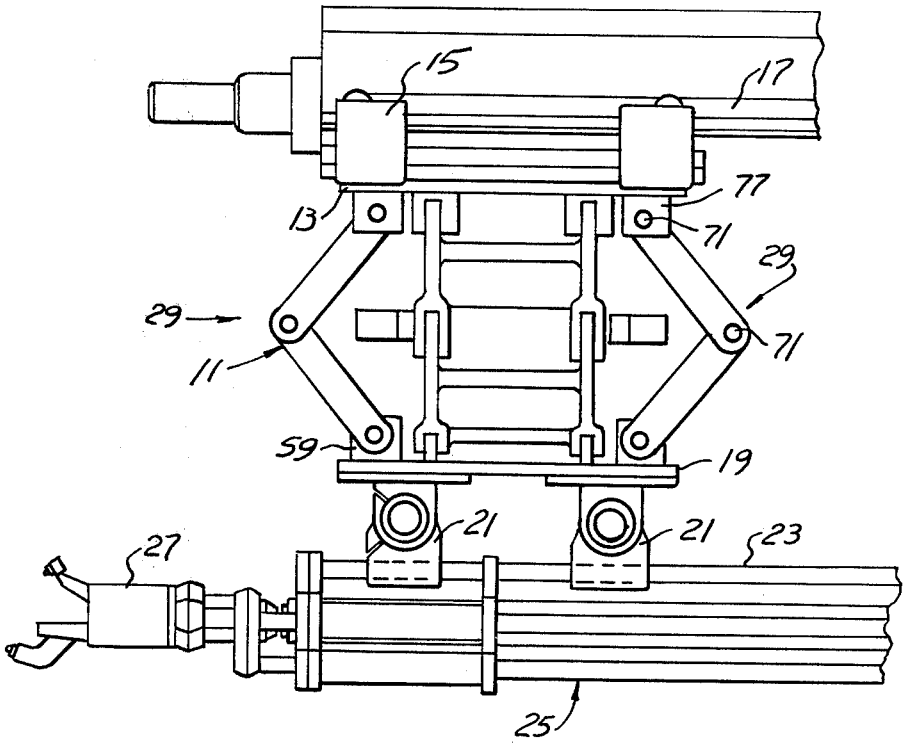
FIG. 1 is a schematic side elevational view of the present automation vertical lift unit suspended from a reciprocal shuttle feed unit, and suspending and supporting a reciprocal work piece gripping, lifting and transport assembly.

Referring to the drawing present automation vertical lift unit is generally indicated at 11 in FIG. 1 having an upper plate 13 which is adapted for suspension from a reciprocal shuttle feed unit 15 for reciprocal traversing movements along the track 17. The vertical lift unit includes spaced below the upper plate the horizontally disposed lower plate 19 adapted for supporting by a suitable clamp support 21 and support rod 23 a reciprocal work piece gripping, lifting and transport assembly 25 including jaw assembly 27.

The environment in which the present vertical lift unit is involved is schematically illustrated in FIG. 1.

In operation the work piece gripping, lifting and transport assembly includes power means such as a combination pneumatic cylinder and piston rod arrangement for advancing the jaws 27 or suction cups into a work area adjacent the bed of a die and in registry with a work piece which has been lifted from the die by the die mechanism. The jaws or suction cups are activated to grip the work piece. The vertical lift unit is activated by its internal cylinder assembly so that the lower plate rises lifting the work piece a predetermined distance. The work piece gripping, lifting and transport assembly is retracted to a predetermined position. The jaws or suction cups release the finished work piece taken from the bed of the press, and the vertical lift unit is again energized for movement in the opposite direction returning the lower plate 19 back to its initial position ready for the next cycle.

The present vertical lift unit is a cylinder actuated adjustable mechanical linkage straight lift unit. When loading or unloading formed or flat parts into and out of dies or other tooling, a straight vertical lift motion is often required. The present lift unit is effective and effecient in accomplishing this result, is stable, durable and of light weight construction relative to the work required of it.

VERTICAL LIFT UNIT

Figures 2, 3:
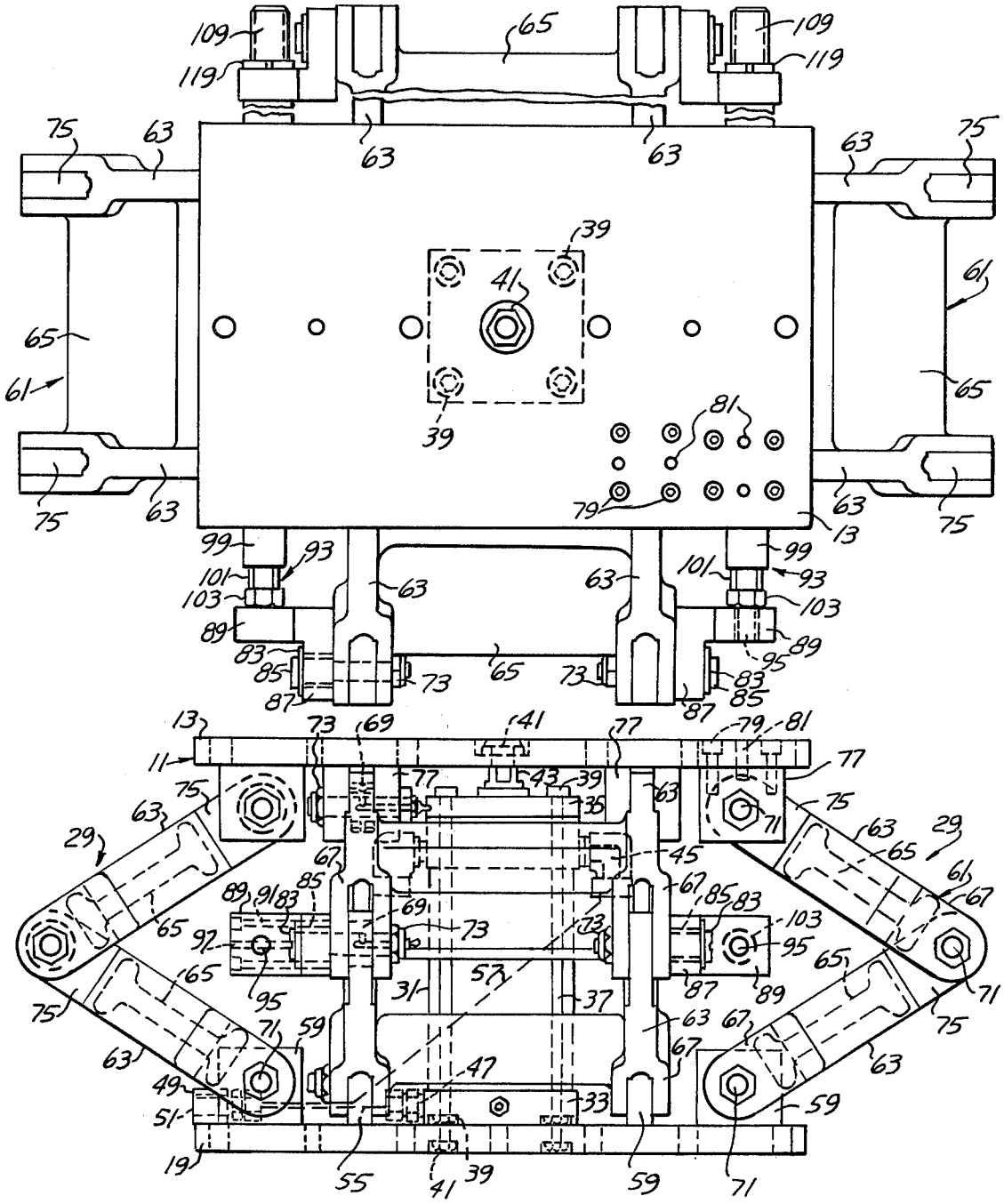
FIG. 2 is a side elevational view of the present vertical lift unit shown in FIG. 1 and upon an increased scale.
FIG. 3 is a fragmentary plan view thereof.
Figure 4:
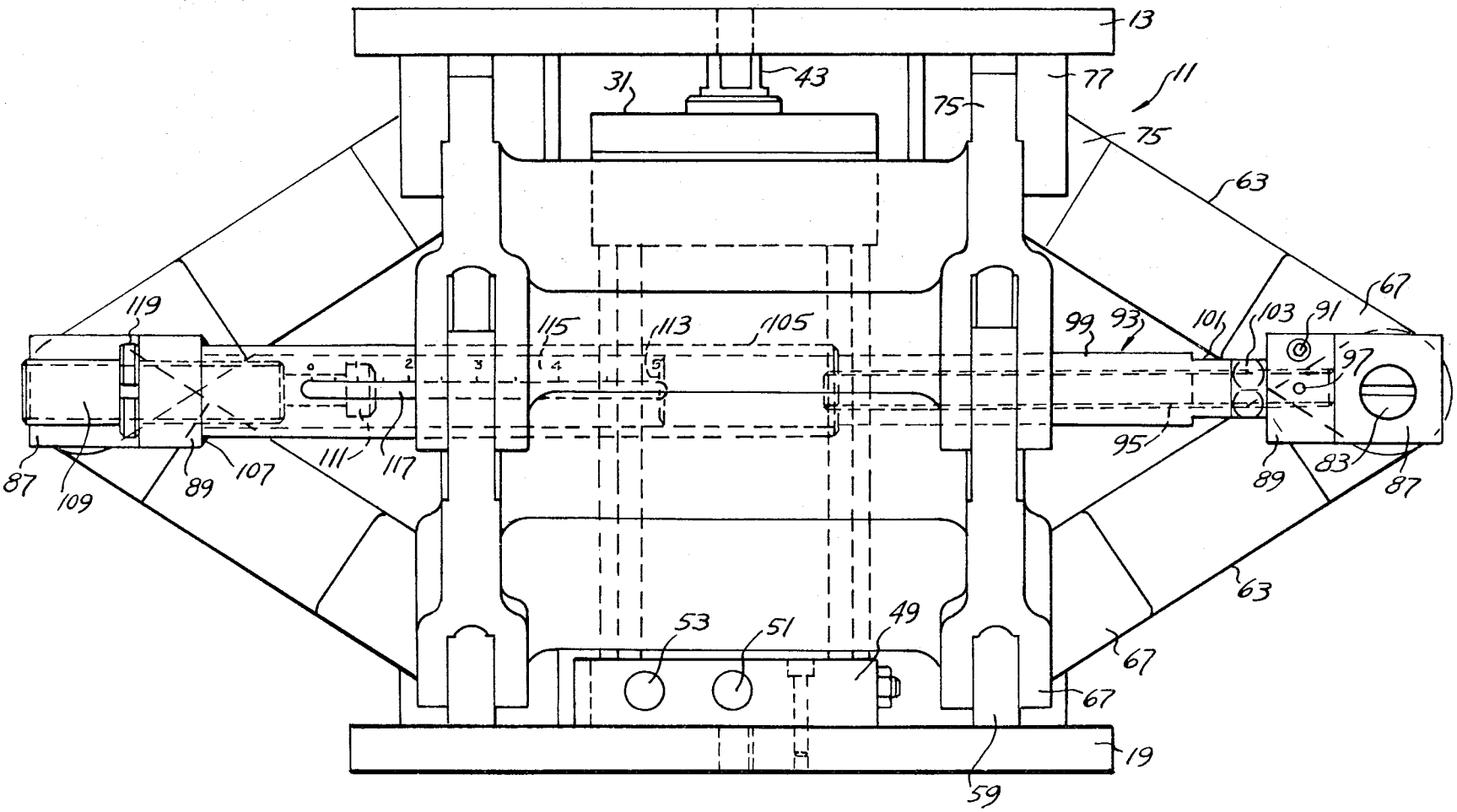
FIG. 4 is a fragmentary side elevational view thereof.

The vertical lift unit 11 is shown in further detail in FIGS. 2, 3 and 4 and provides between the plates 13 and 19 four collapsible bi-fold linkages 29 which are mounted quarter laterally in a rectangular pattern around vertically reciprocating cylinder 31.

Said bi-fold linkage at its respective free ends is pivotally connected to the respective plates 13 and 19 for providing a straight vertical lift motion to the work piece transport assembly 23, 25, 27.

Said operating cylinder includes lower head 33, upper head 35 and a series of tie rods 37 interconnecting the heads with the cylinder body as by the fasteners 39. The respective tie rods extend through corresponding openings within the lower plate 19 and are fixedly secured thereto by the plurality of fasteners 41.

The operating cylinder includes a piston rod 43 and associated piston, projects through the head 35 and is secured to a central portion of the upper plate 13 by lock nut 41, FIGS. 2 and 3.

The upper cylinder head 35 has a port 45 for receiving or alternately exhausting pressure fluid, such as compressed air, and the lower head 33 has a port 47 for alternately receiving and exhausting pressurized fluids.

Manifold block 49 is mounted upon lower plate 19 and secured thereto, FIG. 2 and has a pair of combination pressure and exhaust ports 51 and 53 adapted for connection to suitable control valve which selectively delivers compressed air either to port 51 or to port 53.

There is schematically shown in FIG. 2 a pair of conduits 55 and 57 which interconnect respective cylinder ports 45 and 47 with fittings in the manifold block joining ports 51 and 53.

The respective four collapsible bi-fold linkages 29 are identical in construction and one of said bi-fold linkages is now described.

On each of the four sides of the lower plate 19 there are mounted a pair of upstanding laterally spaced bearing mounts 59, FIG. 2 onto which the lower portions of the respective bi-fold linkages 29 are pivotally mounted and connected as by the pins 71.

Each of the bi-fold linkages includes a pair of pivotally interconnected guide link assemblies of H-shape.

Therefore for all of the four bi-fold linkages 29 there are provided eight slotted interlocking guide link assemblies 61 which are all symmetrical and identical in shape. The respective bi-fold linkages include hinged knuckle joints which are secured at the top, center and bottom by a pin and bearing assemblies for guidably interconnecting the upper and lower plates 13 and 19.

Each guide link assembly 61 includes a pair of laterally spaced guide links 63 having a transverse web 65. Each guide link has a bifurcation 67 at one end and a tongue 75 projecting from its opposite end.

For each bi-fold linkage there is a lower guide link assembly 61 and an upper guide link assembly 61 which are symmetrical in construction and wherein the respective tongues 75 of the lower guide links are received within the bifurcations 67 of the upper guide links and pivotally interconnected by the pins 71 and lock nut 73.

Within the tongue of each guide link 63 there is nested a suitable roller bearing 69 such as shown in FIG. 2 through which the respective pin 71 projects.

As shown in FIGS. 2, 3 and 4 the bifurcations 67 in the lower guide link assemblies extend around the respective bearing mounts 59. Roller bearings 69, similar to what is shown in FIG. 2, are mounted within the respective bearing mounts and receive pins 71.

The upper ends of the bi-fold linkages 29, including the guide links 63 are arranged so that the tongues 75 extend between the respective laterally spaced pairs of pin blocks 77 which depend from upper plate 13 and are suitably secured thereto by fasteners 79, FIG. 2 and associated dowels 81.

Accordingly, eight slotted interlocking guide link assemblies are centrally interconnected by the pins 71, and by additional pivot pins 71 at the respective ends of the guide link assemblies. These are pivoted to the upper and lower plates 13 and 19 and with respect to the depending pin blocks 77 for the upper plate and the upstanding bearing mounts 59 for the lower plate.

The respective bi-fold assemblies 29 are arranged in opposed pairs upon opposite sides of the respective plates, essentially right angularly related.

Interposed between one of said pairs of bi-fold linkages there are provided a pair of combination adjustable lock screw assemblies and interconnecting shock absorber assemblies adapted for selectively preadjusting the collapsing inward extension movements of the bi-fold linkages and in turn the vertical stroke or movement of the lower plate and for cushioning it at the end of its downward movement FIGS. 2, 3 and 4.

As shown in FIG. 2 the lock screw assemblies are mounted upon one of said opposed pairs of bi-fold linkages at the center pivotal connection thereof as shown by the pins 83. The respective pivotal connections between the symmetrical guide link assemblies are slightly modified to provide for the mounting of the combination adjustable lock screw assembly 93 and shock absorber assembly 105, 109, FIG. 4.

For this purpose flanged bearings 85 projected through corresponding mount blocks 87. Pivot pins 83, extend through the flange bearing 85 and mount block, through corresponding aperatures within the pivotally interconnected portions of the adjacent guide links 63, and through the roller bearings 69 within the tongue of one of said guide links and are anchored by lock nuts 73. Connected to each of the mount blocks 87 and extending at right angles thereto is the additional mount block 89 secured thereto by fasteners 91, FIG. 2.

A corresponding assembly of mount blocks 87 and 89 is also swivelly mounted and connected with the opposed center connections of the other bi-fold linkage opposite from the bi-fold linkage shown in FIGS. 2 and 3. The respective mount blocks 89 provide the mounting for the above adjustable lock screw assembly and interconnected shock absorber assembly.

The rod screw assembly generally indicated at 93, FIGS. 3 and 4, includes the horizontally disposed adjusting screw 95 which extends through an aperture in mount block 89 and is secured therein by the transverse spring pin 97.

Internally threaded stop rod 99 is threaded over the adjusting screw at one end, and at its other end slidably and guidably axially into the shock mount tube 105.

Stop rod 99 has at one end FIG. 4 opposed wrench engaging flats 101 to facilitate rotation of said rod with respect to the stationary adjusting screw 95 for effecting relative longitudinal adjustments of said rod with respect to mount block 89. Once adjusted, the stop rod is secured in place by jam nut 103. The other end of the shock rod tube, again parallel to the plates 13 and 19 extends to and is secured to the mount block 89 of the opposed bi-fold linkage as by the welds 107.

A shock absorber assembly 109 containing hydraulic fluid and the oil cushioned snubber 111 is projected within one end of mount tube 105 and secured therein by the lock ring 119 which is interconnected with the shock absorber and operatively bears against the respective mount block 89. In the illustrative embodiment the exterior of the shock absorber 109 is threaded for adjustable threading into one end of the shock mount tube 105.

The present adjustable lock screw assembly and the associated interconnected shock absorber assembly provide a means of adjusting and cushioning the lower plate 19 at the end of its vertical work stroke. This is important because the adjustability of the vertical work stroke is a key feature in that vertical tooling clearances are often critical.

The stroke adjustment is accomplished by the adjustable and lockable pairs of rod screw assemblies 93 each of which include stationary adjusting screw 95 and the rotatably adjustable internally threaded stop rod 99 secured in adjusted position by jam nut 103. Upon such extension of cylinder 31 with respect to its piston rod 43 there will be downward movement of lower plate 19 with respect to the upper plate 13, in a straight line until the end 113 of the stop rod 99 operatively engages snubber 111 and cushioning and stopping further relative downward movement of plate 19.

In the illustrative embodiment FIG. 2, the bottom plate 19 is set for a relative movement with respect to plate 13 of five inches. This is shown on the scale 115 which extends along the laterally opening slot 117 of shock mount tube 105. This provides a visual indication of the location of the snubber 111 with respect to the rod end 113 before the beginning of downward movement of the plate 19. By loosening jam nut 103 the stop rod 99 can be rotatably adjusted at the wrench engaging flats 101 and the rod end 113 moved inwardly along the scale 115 to a preselected position which corresponds to the extent of desired downward or upward movement for the plate 19.

Since the snubber 111 overlies a portion of the scale it can be assumed that the snubber 111 will retract approximately to the zero indication on scale 115. This thus provides a cushioned stop at the end of the unit's downward stroke. The unit can also be inverted and thus provide for a cushioned up stroke.

The respective adjustment screw tube rod assemblies are positioned upon opposite sides of the cylinder laterally thereof for traversing the short side of the rectangle defined by the top plate 113 shown in FIG. 3.

The respective adjustable lock screw assemblies and shock absorber assemblies are swivelly connected to the center fold knuckle joints of the opposing linkages using the same axis pin 83 that secures the joint between the opposing guide link assemblies of the respective one pair of bi-fold linkages.

The stroke adjustment can be modified by changing the length of the rod screw assembly 93, FIG. 4. This provides a limit and control for inward travel of the opposing central bi-fold joints that are attached to this opposed pair of bi-fold linkages thus restricting downward travel of the lower plate.

Having described my invention reference should now be had to the following claims.

I claim:

1. An automation vertical lift unit comprising a horizontally disposed upper plate adapted for suspension from a reciprocal shuttle feed unit;

a horizontally disposed lower plate adapted for supporting a reciprocal work piece, gripping, lifting and transport assembly;

a cylinder assembly interposed between and interconnecting said plates for effecting relative vertical movement between said plates;

a series of bi-fold linkages mounted quarter-laterally in a rectangular pattern around said cylinder assembly, interposed between said plates and at their respective free ends pivotally connected thereto, for providing straight vertical lift motions to said work piece transport assembly at predetermined intervals;

said bi-fold linkages being arranged in opposed spaced pairs;

and a combination adjustable lock screw assembly and interconnected shock absorber assembly interposed between one of said pairs of bi-fold linkages, for selectively preadjusting the vertical work stroke of said lower plate and cushioning its downward movements.

2. In the vertical lift unit of claim 1, said lock screw assembly including an elongated adjusting screw parallel to said plates, at one end swivelly connected to the pivotal connection between one of said opposed pairs of bi-fold linkages;

an elongated rotatably adjustable stop rod at one end threaded over said screw;

said shock absorber assembly including an elongated tube at one end swivelly connected to the pivotal connection between the other of said opposed pair of bi-fold linkages;

and at its other end guidably receiving the other end of said stop rod;

and a shock absorber within said one end of said elongated tube including an axially directed snubber normally spaced from the other end of said stop rod;

and operably engageable therewith limiting relative inward pivotal movements of said one pair of said opposed bi-fold linkages.

3. In the vertical lift unit of claim 1, said bi-fold linkages being arranged in opposed spaced pairs;

there being a pair of laterally spaced combination adjustable lock screw assemblies and interconnected shock absorber assemblies upon opposite sides of said cylinder assembly interposed between one of said pairs of bi-fold linkages.

4. In the vertical lift unit of claim 3, each of said lock screw assemblies including an elongated adjusting screw parallel to said plates at one end swivelly connected to the pivotal connection between one of said opposed pairs of bi-fold linkages;

an elongated rotatably adjustable stop rod at one end threaded over said screw;

said shock absorber assembly including an elongated tube at one end swivelly connected to the pivotal connection between the other of said opposed pair of bi-fold linkages;

and at its other end guidably receiving the other end of said stop rod;

and a shock absorber within said one end of said elongated tube including an axially directed snubber normally spaced from the other end of said stop rod, and operably engageable therewith limiting relative inward pivotal movements of said one pair of said opposed bi-fold linkages.

5. In the vertical lift unit of claim 2, selective rotation of said stop rod being adapted to variably adjust the initial spacing between said other end of said stop rod and snubber;

and a jam nut threaded on said adjusting screw and operably engageable with said stop rod for securing it in adjusted position.

6. In the vertical lift unit of claim 5, there being an elongated lateral slot formed through said tube providing a visual indication of the initial spacing of said other end of said stop rod relative to said snubber.

7. In the vertical lift unit of claim 6, and a scale with indicia upon the exterior of said tube along said slot for measuring and adjustably presetting said spacing.

* * * * *